US009584947B2

(12) United States Patent
Deprez et al.

(10) Patent No.: US 9,584,947 B2
(45) Date of Patent: Feb. 28, 2017

(54) OPTIMIZED CALIBRATION OF A MULTI-LOUDSPEAKER SOUND PLAYBACK SYSTEM

(71) Applicant: Orange, Paris (FR)

(72) Inventors: Romain Deprez, Paris (FR); Rozenn Nicol, La Roche Derrien (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 14/429,291

(22) PCT Filed: Sep. 5, 2013

(86) PCT No.: PCT/FR2013/052047

§ 371 (c)(1),
(2) Date: Mar. 18, 2015

(87) PCT Pub. No.: WO2014/044948

PCT Pub. Date: Mar. 27, 2014

(65) Prior Publication Data

US 2015/0223004 A1 Aug. 6, 2015

(30) Foreign Application Priority Data

Sep. 18, 2012 (FR) ..... 12 58760

(51) Int. Cl.

| | |
|---|---|
| ***H04R 5/02*** | (2006.01) |
| ***H04S 7/00*** | (2006.01) |
| ***G10L 19/008*** | (2013.01) |

(52) U.S. Cl.

CPC ..... *H04S 7/301* (2013.01); *G10L 19/008* (2013.01); *H04S 2420/11* (2013.01)

(58) Field of Classification Search

CPC ..... H04S 7/301; H04S 2420/11; G10L 19/08
See application file for complete search history.

(56) References Cited

U.S. PATENT DOCUMENTS

2006/0262939 A1 11/2006 Buchner et al.

OTHER PUBLICATIONS

Deprez et al., "Theoretical validation of the correction of reflections on the basis of a representation in spherical harmonics", Apr. 16, 2010, Congress of French Acoustics.*

(Continued)

*Primary Examiner* — Regina N. Holder
(74) *Attorney, Agent, or Firm* — David D. Brush; Westman, Champlin & Koehler, P.A.

(57) ABSTRACT

A method of calibrating a sound restitution assembly for a multichannel sound signal, which includes a plurality of loudspeakers. The method includes: obtaining multidirectional impulse responses of the loudspeakers to reproduction of a predetermined audio signal; analyzing the multidirectional impulse responses obtained, in a domain of spatio-temporal representation, over at least one time window encompassing the instants of arrival of the first reflections of the audio signal reproduced to determine a set of characteristics of the first reflections; comparing the amplitude of each of the reflections with a predetermined perceptibility threshold and identifying imperceptible reflections for which the amplitude is below the predetermined threshold; modifying the impulse responses obtained to obtain perceptive impulse responses, by deleting the reflections identified as imperceptible; and determining a filtering matrix on the basis of the perceptive impulse responses for an application of this filtering matrix to the multichannel audio signal before sound restitution.

11 Claims, 6 Drawing Sheets

(56) References Cited

OTHER PUBLICATIONS

International Search Report and Written Opinion dated Nov. 22, 2013 for International Application No. PCT/FR2013/052047, filed Sep. 5, 2013.

Hacihabibglu H. et al., Perceptual Simplification for Model-Based Binaural Room Auralisation, Applied Acoustics, Elsevier Publishing, GB, vol. 69, No. 8, Aug. 1, 2008 (Aug. 1, 2008), pp. 715-727, XP022703192.

Etienne Corteel et al., "Listening room Compensation for Wave Field Synthesis. What can be done?" AES 23rd International conference, May 23, 2003 (May 23, 2003),—May 25, 2003 (May 25, 2003), pp. 1-17, XP040374481. Copenhagen Denmark section "Describing the lisening room: measuring and parametrizing"; p. 5-p. 6 section "Room compensation for WFS: modifying the virtual sound scene parametrization"; p. 13 section "A Case study: room compensation for plane wave"; p. 13-p. 16; figures 13-18.

Jorg M. Buchholz et al., "Room Masking: Understanding and Modelling the Masking of Room Reflections", AES 110th Convention 2001, May 12, 2001 (May 12, 2001),—May 15, 2001 (May 15, 2001), pp. 1-7, XP040371707.

* cited by examiner

OPTIMIZED CALIBRATION OF A MULTI-LOUDSPEAKER SOUND PLAYBACK SYSTEM

CROSS-REFERENCE TO RELATED APPLICATIONS

This Application is a Section 371 National Stage Application of International Application No. PCT/FR2013/052047, filed Sep. 5, 2013, the content of which is incorporated herein by reference in its entirety, and published as WO 2014/044948 on Mar. 27, 2014, not in English.

FIELD OF THE DISCLOSURE

The present invention relates to a method and device for calibrating a sound playback system having a plurality of loudspeakers or sound playback elements. Calibration makes it possible to optimize the sound quality of the playback system formed by the set of playback elements, comprising the loudspeaker device and the listening room.

BACKGROUND OF THE DISCLOSURE

The particular playback systems in question are sound playback systems of multi-channel type (5.1, 7.1, 10.2, 22.2, etc.) or ambisonic type (ambisonics in the literature or higher order ambisonics (HOA)).

To allow good quality playback of multi-channel signals, present-day devices for calibrating the acoustics of the listening site are based on a general method of "multi-channel equalization" type in which the impulse responses of each loudspeaker in the playback system are measured using one or more microphones at one or more points at the listening site and frequency equalization filtering is carried out on each loudspeaker, independently, by inverting all or part of the impulse response measured for the loudspeaker in question.

The inversion aims to correct the response of the loudspeaker in such a way that said response comes as close as possible to a "target" curve generally defined in the frequency domain in order to improve the delivery of the tone of the sound sources.

Such a method is described in the document titled "*Digital Filter Design for Inversion Problems in Sound Reproduction*", by Kirkeby and Nelson, in JAES 7/8, pp. 583-595, 1999, for example.

This type of calibration or correction focuses on correction of the frequency aspect of the response of the playback system at the listening site without making use of temporal information such as reflection phenomena and notably early reflections of the sound signals.

However, early reflections of sound signals have a non-negligible effect on the auditory perception of the reproduced sound signal.

In addition, the analysis of the impulse responses carried out in existing calibration methods is of monophonic type, i.e. it does not take into account the spatial information of the reflections, such as the direction of incidence, either.

The absence of temporal and spatial data for the reflections does not allow consideration of the role of these reflections in the perception of the direct wave of the sound signal by a listener, and thus adjustment of the correction according to their specific effect. The quality of the sound signal played back and perceived by the listener is then less than optimum.

The techniques of the prior art are based on the application of corrective filters to each of the channels of the multi-channel signal, i.e. each loudspeaker in the playback system is corrected individually without taking into account the whole array of loudspeakers.

There is therefore a need to optimize the calibration carried out on systems for playing back multi-channel audio signals, firstly to take into account the temporal and spatial properties of the sound reflections that affect the auditory perception of the direct waves, in order to adjust the processing endeavor according to the perceptibility of degradation and thus to limit the audible artefacts liable to be generated by the excessively constrained processing carried out in existing calibration methods, and secondly to use the various loudspeakers jointly, in order to distribute the processing endeavor between all the loudspeakers.

SUMMARY

The present invention provides an improvement for the situation.

For this purpose, it proposes a method for calibrating an assembly for sound playback of a multi-channel sound signal having a plurality of loudspeakers. The method is such that it has the following steps:

- obtaining multi-directional impulse responses from the loudspeakers of the playback assembly upon reproduction of a predetermined audio signal;
- analyzing the multi-directional impulse responses obtained, in a domain of spatio-temporal representation, over at least one time window encompassing the instants of arrival of the early reflections of the reproduced predetermined audio signal in order to determine a set of characteristics of the early reflections comprising at least the amplitude;
- comparing the amplitude of each of the reflections with a determined perceptibility threshold and identifying the non-perceptible reflections for which the amplitude is below the determined threshold;
- modifying the impulse responses obtained in order to obtain perceptual impulse responses, by suppression of the reflections identified as non-perceptible;
- determining a filtering matrix from the perceptual impulse responses for an application of this filtering matrix to the multi-channel audio signal before sound playback.

Thus, when implementing the correction of the multi-channel audio playback system, the effect of the early reflections of the sound waves broadcast by the playback system on the auditory perception of the direct waves is evaluated and taken into account in order to adapt the processing applied to the channels of the multi-channel signal according to the specific perceptual effect associated with each reflection. The filtering of the channels of the multi-channel signal thus exclusively takes into account the reflections that have an effect on the auditory perception of the direct waves.

This therefore makes it possible to increase the quality of the audio signal in playback.

In addition, as it is not necessary to take into account the reflections that are not perceptible, in the sense that their amplitude is below a perceptibility threshold, the constraints of the correction are alleviated due to the fact that they take into account the perceptual impulse responses instead of the raw impulse responses. In addition, some of the non-perceptible reflections that are eliminated from the impulse responses obtained correspond to components of the impulse response which happen to be at the origin of instabilities in the processing (particularly components with non-minimal phases). With the perceptual impulse responses, the risk of instabilities and artefacts which can be generated during processing taking all the reflections into account is thus reduced.

The various particular embodiments cited below can be added independently or in combination with one another to the steps of the method defined above.

In an embodiment of the invention, the perceptibility threshold is determined as a function of characteristics of the direct wave and of the early reflections of the predetermined audio signal.

The influence of the reflections on the perception of the direct wave does indeed depend on several characteristics of the reflections. Advantageously, the perceptibility threshold can be obtained from characteristics determined by the step of analyzing the multi-directional impulse responses of the loudspeakers.

More particularly, the perceptibility threshold is determined as a function of the direction of incidence of the direct wave and/or its amplitude, and the directions of incidence of the early reflections and/or their arrival times with respect to the direct wave.

The effect of a reflection on the perception of the direct wave generally depends on five parameters in total; firstly it depends on two characteristics of the direct wave: its amplitude and its direction; secondly it depends on three characteristics of the reflection: its amplitude, its instant of arrival and its incidence.

However, if one of the characteristics of the direct wave is not known, it is possible to estimate the missing characteristic by giving the other characteristic a set arbitrary value.

In the same way, if one of the items of information relating to the reflections is not known, it is possible, for example, to estimate the perceptual effect of the reflection by giving the missing characteristic a set arbitrary value, for example taking the value corresponding to the least favorable case in order to increase perceptibility. Thus, in the case where only the information about the direction of the reflections is known, it is possible to give a set value to the characteristic of the instant of arrival of the reflection in order to determine a threshold perceptibility value solely with respect to the value of the direction; in the same way, if only the information about the instant of arrival of the reflection is known, it is possible to give a set value to the direction and determine the perceptibility threshold only according to the value of the instant of arrival. Finally, in the case where both characteristics are known, the threshold value can be determined as a function of these two characteristics.

In a particular embodiment, the determination of the filtering matrix has the steps of:

- determination of an error signal defined by the difference between a predetermined target response signal for the playback system and a response signal reconstructed from the perceptual impulse responses;
- multi-channel inversion by minimization of the error signal thus determined in order to obtain the filters of the filtering matrix.

The error signal thus determined makes it possible to take into account only the reflections that have an effect on the auditory perception of the direct wave when computing the filtering matrix. Indeed, only the reflections that are not perceptible are removed for the determination of the error signal.

In a possible embodiment, the predetermined target response signal corresponds to the response of the direct wave alone without any reflection.

This makes it possible to consider a signal devoid of any room effects as a reference signal.

In a first variant embodiment, the predetermined target response signal corresponds to the response of a direct wave associated with reflections representing a predetermined listening site.

The reference response can then be deliberately chosen as a required listening site in which the sound is of a desired quality.

In a second variant embodiment, the predetermined target response signal corresponds to the response of a direct wave associated with reflections representing a different playback assembly.

The reference response is chosen in this case as a function of a chosen reference playback system, in which the number and the position of the loudspeakers can differ from those of the playback system that is the subject of the correction.

The present invention also concerns a device for calibrating an assembly for sound playback of a multi-channel sound signal having a plurality of loudspeakers. This device is such that it has:

- a module for obtaining multi-directional impulse responses from the loudspeakers of the playback assembly upon reproduction of a predetermined audio signal;
- a module for analyzing the multi-directional impulse responses obtained, in a domain of spatio-temporal representation, over at least one time window encompassing the instants of arrival of the early reflections of the reproduced predetermined audio signal in order to determine a set of characteristics of the early reflections comprising at least the amplitude;
- a module for comparing the amplitude of each of the reflections with a determined perceptibility threshold and for identifying the non-perceptible reflections for which the amplitude is below the determined threshold;
- a module for modifying the impulse responses obtained in order to obtain perceptual impulse responses, by suppression of the reflections identified as non-perceptible by the identification module;
- a module for computing a filtering matrix from the perceptual impulse responses for an application of this filtering matrix to the multi-channel audio signal before sound playback.

This device exhibits the same advantages as the method described previously, which it implements.

The invention also pertains to an audio decoder having a calibration device as described.

It pertains to a computer program having code instructions for the implementation of the steps of the calibration method as described when these instructions are executed by a processor.

Finally, the invention relates to a storage medium, readable by a processor, integrated or not into the calibration device, optionally removable, storing in memory a computer program implementing a calibration method as described previously.

BRIEF DESCRIPTION OF THE DRAWINGS

Other characteristics and advantages of the invention will become more clearly apparent on reading the following description, given solely by way of non-limiting example, and written with reference to the appended drawings, in which.

DETAILED DESCRIPTION OF ILLUSTRATIVE EMBODIMENTS

Figure 1:
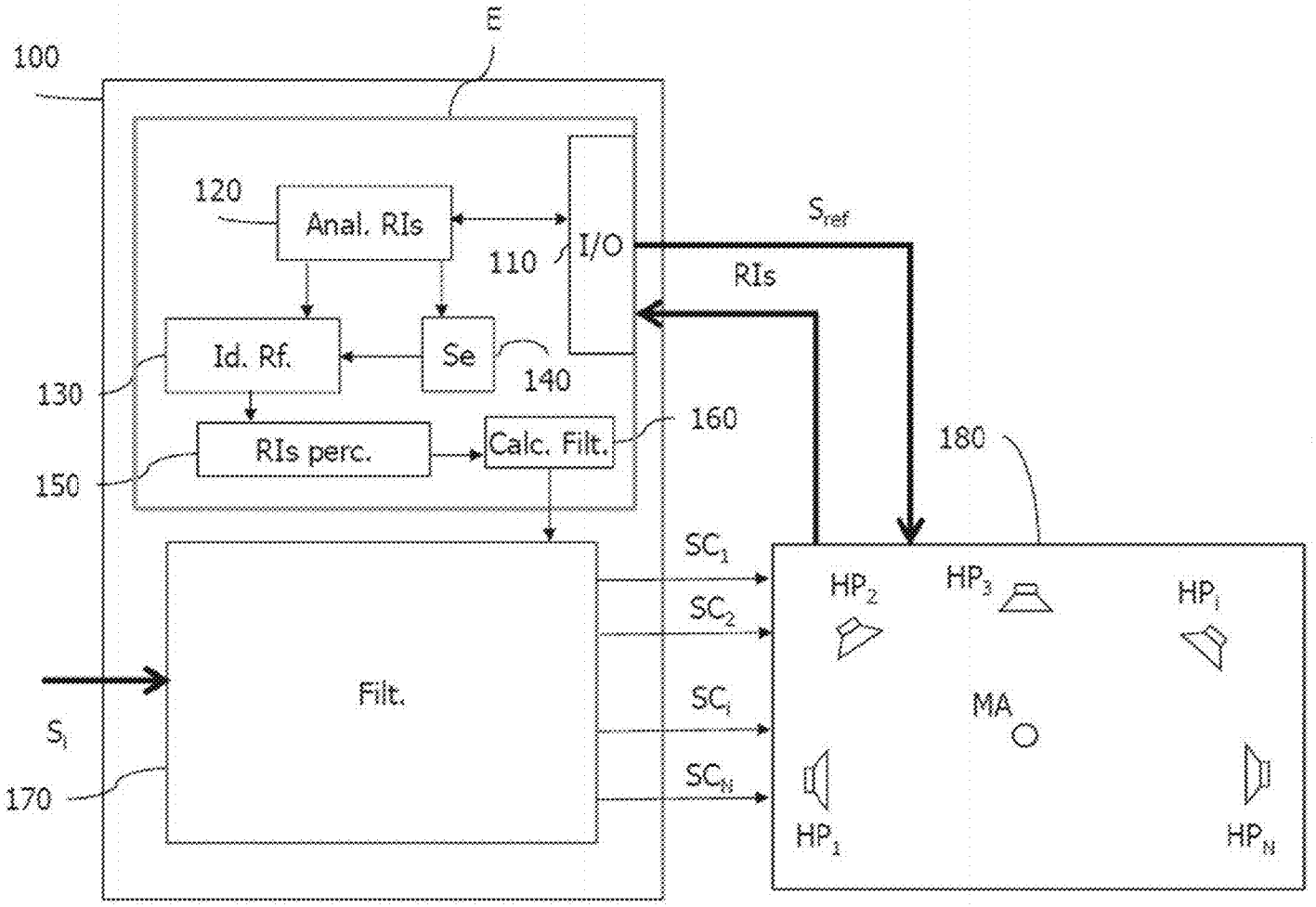
FIG. 1 represents a sound playback system and a device for calibrating the playback system according to an embodiment of the invention.

FIG. 1 therefore illustrates an example of a sound playback system in which the calibration method according to an embodiment of the invention is implemented. This system has a processing device 100 having a calibration device E according to an embodiment of the invention driving a playback assembly 180 which has a plurality of playback elements (loudspeakers, enclosures, etc.), represented in this case by loudspeakers $HP_1$, $HP_2$, $HP_3$, $HP_i$ and $HP_N$.

These loudspeakers are arranged at a listening site at which a microphone or set of microphones MA is also provided.

These loudspeakers and microphones are driven by a processing device 100, which can be a decoder such as a home decoder of "set top box" type to read or broadcast audio or video content, a processing server capable of processing audio and video content and retransmitting them to the playback assembly, a conference bridge capable of processing the audio signals of various conference sites or any device for audio processing of multi-channel signals.

The processing device 100 has a calibration device E according to an embodiment of the invention and a filtering matrix 170 composed of a plurality of processing filters which are determined by the calibration device according to a calibration method as illustrated subsequently with reference to FIG. 2.

This filtering matrix receives a multi-channel signal Si as input and transmits the signals $SC_1$, $SC_2$, $SC_i$, $SC_N$ as output, said signals being capable of being played back by the playback assembly 180.

The calibration device E has a reception and transmission module 110 capable of transmitting audio reference signals (Sref) to the various loudspeakers of the playback assembly 180 and of receiving the multi-directional impulse responses (RIs) from these various loudspeakers, corresponding to the broadcasting of these reference signals, by way of the microphone or the assembly of microphones MA.

A multi-directional impulse response contains the temporal information and spatial information relating to the set of sound waves induced by the loudspeaker under consideration in the playback room.

The reference signals are, for example, signals whose frequency increases logarithmically with time, these signals being called logarithmic "chirps" or "sweeps".

The convolution of the signal measured at the loudspeaker output with an inverse reference signal makes it possible to obtain the impulse response of the loudspeaker directly.

In a particular embodiment suitable for the domain of spherical harmonic representation linked to the ambisonic or HOA format, the microphone capable of measuring the multi-directional impulse responses of the loudspeakers is a microphone of HOA type placed at a point at the listening site, for example in the center of the loudspeakers of the playback assembly.

This microphone will receive, for each loudspeaker playing back an audio reference signal, the sound played back in several directions. Indeed, the HOA microphone is composed of a plurality of microphones. The spatial information of the different sounds captured can be extracted by way of an appropriate process. For more detail on this type of microphone, the reader is referred to the document titled "Etude et réalisation d'outils avancés d'encodage spatial pour la technique de spatialisation sonore Higher Order Ambisonics: microphone 3D et contrôle de la distance" by S. Moreau, Univ. of Maine, PhD thesis, 2006.

The HOA microphone then retrieves the multi-directional impulse responses of each of the loudspeakers in order to transmit them to the calibration device or to store them in memory in a local or remote memory space.

When this information is stored in the memory, these multi-directional impulse responses are then obtained by the calibration device according to the invention by simple reading from memory.

These multi-directional impulse responses make it possible to obtain information on the directions of arrival of the direct waves and the reflections of the played-back signal as well as information on the arrival times of both the direct waves and the reflections.

The analyzing module 120 of the device E carries out a joint analysis of the impulse responses obtained which makes it possible to obtain these characteristics and particularly the characteristics of the early reflections of the played-back signals. In the particular embodiment adapted to the domain of representation of spherical harmonics, the multi-directional impulse responses are obtained in a spatio-temporal representation where the spatial information is described on the basis of the spherical harmonics and makes it possible to identify the directions of incidence of the various sound components. In this way, all the information about the amplitude of the reflections, their directions of arrival and their arrival times in comparison with the arrival time of the direct wave is finally obtained. This step will be described later with reference to FIG. 2.

The analysis of the impulse responses is performed on a predetermined time scale, encompassing the instants of the early reflections.

In an exemplary embodiment, this time window has a length between 50 and 100 ms, which corresponds to the time scale of the instants of arrival of the early reflections.

Of course, the embodiment thus described is suitable for the domain of spherical harmonic representation but it is perfectly envisionable to carry out these same steps in a WFS (for "Wave Field Synthesis") representation domain or in the plane wave domain. In these situations, the means of picking up the signals played back by the loudspeakers will be adapted to these domains of representation in order to obtain multi-directional impulse responses, without this departing from the scope of the invention.

The calibration device E also has a module 130 for comparing and identifying non-perceptible reflections. This module implements a step of comparing the amplitudes of the reflections obtained by the analysis module 120 with a predetermined perceptibility threshold Se. This perceptibility threshold is determined by the module 140 from a predefined table of values stored in a memory space.

The determination of this perceptibility threshold will be explained further on with reference to FIGS. 4 and 5.

In the case where the amplitude of a reflection is below the perceptibility threshold as defined, this means that this reflection has no significant impact on the auditory perception of the direct wave of the played-back signal.

A step of identifying these "non-perceptible" reflections is then implemented by the module 130. These identified reflections make it possible for the module 150 to implement a step of determination of perceptual impulse responses which are deduced from the impulse responses obtained by the module 110 by suppression of the reflections deemed non-perceptible.

Thus, only the reflections that have an effect on the perception of the direct waves are taken into account for computing, in the module 160, the filtering matrix Filt of the matrix filtering module 170.

Figure 2:
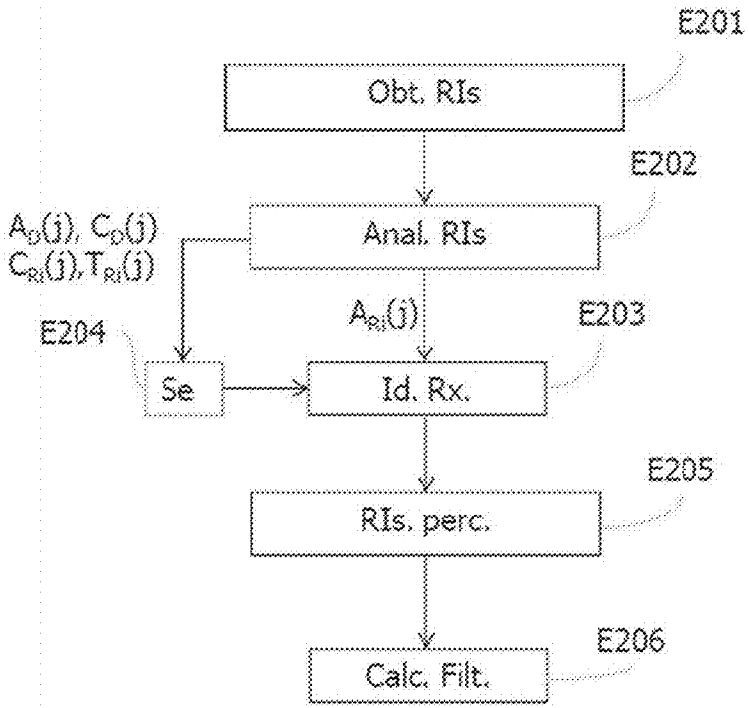
FIG. 2 represents the main steps of a calibration method according to an embodiment of the invention, in the form of a flow chart.

FIG. 2 illustrates the main steps implemented in an embodiment of the calibration method according to the invention in the form of a flow chart.

In step E201, the multi-directional impulse responses of the various loudspeakers in the playback assembly as described with reference to FIG. 1 are obtained. They are obtained by the calibration device, or by simple reading of the memory if these responses have been saved beforehand, either by reception from the microphone or from an assembly of microphones that has carried out the measurement.

These multi-directional impulse responses are the responses of each loudspeaker following the reproduction of a reference signal as described with reference to FIG. 1.

Figure 3A:
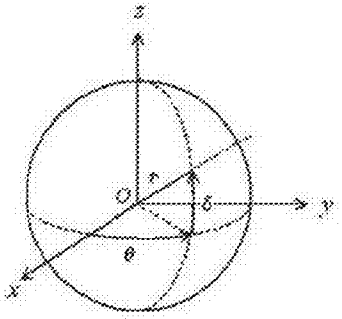
FIG. 3*a* is a representation of a spherical frame of reference.

A step E202 of analyzing the multi-directional impulse responses thus obtained is implemented. This analysis is carried out in a domain of spatio-temporal representation. The spatial information can, for example, be described in the domain of spherical harmonic representation. In this representation illustrated in FIG. 3*a*, each point has, as spherical coordinates, a distance r with respect to the origin 0, an angle θ of azimuth or orientation in the horizontal plane and an angle δ of elevation or orientation in the vertical plane. Preferably, the direction defined by (θ=0°,δ=0°) corresponds to the direction facing the listener. In such a frame of reference, an acoustic wave is described perfectly if one defines at all points, at each instant t, the acoustic pressure denoted p(r, θ, δ, t), whose time-based Fourier transform is denoted P(r, θ, δ, f), where f denotes the time-based frequency.

In the context of higher-order ambisonic spatialization (HOA), the spatial components are ambisonic components $B_{mn}^{\sigma}$ which correspond to the decomposition of the wave of acoustic pressure p based on spherical harmonics. For example, for a sound source in the far field, i.e. a planar wave of incidence ($\theta_S$, $\delta_S$) carrying a signal S(t), the ambisonic components $B_{mn}^{\sigma}$ are given by:

$B_{mn}^{\sigma}=S(t)\cdot Y_{mn}^{\sigma}(\theta_S, \delta_S)$ where the spherical harmonic functions $Y_{mn}^{\sigma}(\theta, \delta)$ describe an orthonormal base:

$$Y_{mn}(\theta, \delta) = \sqrt{(2m+1)(2-\delta_{0,n})\frac{(m-n)!}{(m+n)!}}$$

$$P_{mn}(\sin\delta)\times\begin{cases}\cos n\theta & si\sigma=+1\\ \sin n\theta & si\sigma=-1\ \text{(ignored if } n=0)\end{cases}$$

The $P_{mn}(\sin\delta)$ are the associated Legendre functions.

Figure 3B:
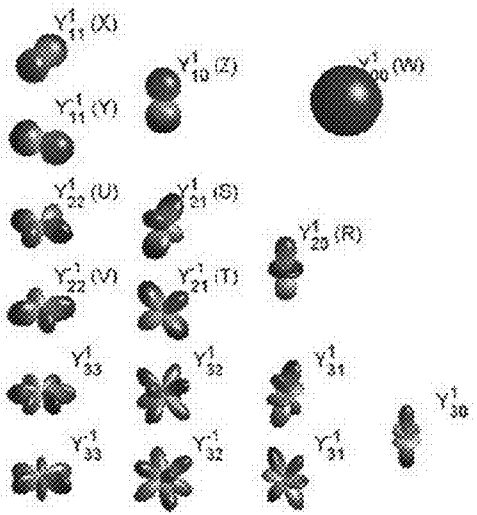
FIG. 3*b* illustrates the spherical harmonic components in the case of a third-order ambisonic spatial representation.

An illustration of spherical harmonic functions is represented in FIG. 3*b*. The omnidirectional component $Y_{00}^{1}$ (denoted as the "component W" in ambisonic terminology) corresponding to the $0^{th}$ order, the bidirectional components $Y_{10}^{1}, Y_{11}^{1}, Y_{11}^{-1}$ (respectively denoted as the "Z, X and Y" components in ambisonic terminology) corresponding to the $1^{st}$ order and the components of the higher orders may thus be seen.

A three-dimensional or "3D" spatial representation said to be "of order M" comprises $K=(M+1)^2$ components whose triplets of indices {m,n,σ} are such that 0≤m≤M, 0≤n≤m, σ=±1. A two-dimensional or "2D" representation of order M comprises a sub-set of these components by retaining only the indices m=n, or K=2M+1 components.

The decomposition on the basis of spherical harmonics can be considered as the dual transform between spatial coordinates and the spatial frequencies. The components $B_{mn}^{\sigma}$ therefore define a spatial spectrum.

For each loudspeaker, at the end of step E201, a multi-directional impulse response is obtained that is composed of K impulse responses corresponding to the K components of the chosen spatial representation. In the case of the spherical harmonic representation, these are the K components on the K=2M+1 spherical harmonics under consideration. For the $ji^{th}$ loudspeaker, the multi-directional impulse response that is associated with it is thus composed of K elementary responses $H_{jI}(t)$, where the index I references the index of the spatial component and t corresponds to the temporal sample. Hereinafter, the vector of the K spatial components measured for the $ji^{th}$ loudspeaker will be denoted $h_j(t)$:

$$h_j(t)=[H_{j1}(t)\ \ldots\ H_{jI}(t)\ \ldots\ H_{jK}(t)].$$

If the reproduction system comprises N loudspeakers in total, the set of multi-directional impulse responses measured for the N loudspeakers and the K spatial components defines a matrix H of size K×N, in which the $ji^{th}$ column corresponds to the multi-directional impulse response associated with the $ji^{th}$ loudspeaker.

For each loudspeaker, the K spatial components contained in the vector $h_j(t)$ represent the spatial spectrum of the sounds captured by the microphone. To access the information about the direction of the sounds, it is therefore advisable to carry out an inverse transformation in order to change back from a representation as a function of spatial frequencies to a representation as a function of spatial coordinates.

This inverse transformation is performed by reconstructing the pressure wave p(r, θ, δ, t) by linear combination of the spherical harmonics, each harmonic being weighted by the amplitude of the component that is associated with it. These elements are found in the thesis by S. Moreau cited above.

The pressure wave p(r, θ, δ, t) can then be evaluated at any point of a sphere centered on the point of measurement of the multi-directional impulse responses by reconstructing the pressure wave point by point by linear combination of the spherical harmonics. For example, it is possible to evaluate this pressure on an array of P points defining a "regular sampling" of the sphere in the sense defined in the thesis by S. Moreau. This operation is then similar to spatial decoding of the ambisonic components for playback by a regular spherical array of P virtual loudspeakers. This step of spatial decoding is described in the document titled "Ambisonics encoding of other audio formats for multiple listening conditions" by Jérôme Daniel, Jean-Bernard Rault and Jean-Dominique Polack in AES 105$^{th}$ Convention, September 1998, for example.

In practice, this transformation of the spatial frequencies (ambisonic components) to spatial coordinates is carried out by multiplying the vector $h_j(t)$ by a decoding matrix D, for each loudspeaker and each time sample t. For example, the matrix D can be obtained as $D=Y^T$, where the matrix Y is computed by evaluating the K spherical harmonics $Y_{mn}^{o}(\theta, \delta)$ for the P directions of the virtual loudspeakers, by grouping the azimuths $\theta_q$ and elevations $\delta_q$ into a single doublet $C=(\theta_q, \delta_q)$ associated with a loudspeaker (q denotes the index of the loudspeaker). In the matrix Y, each column is composed of the values of the K spherical harmonics for a given loudspeaker. Finally, for each loudspeaker and each time sample t, a vector $G_j(t)$ of length P is obtained describing the spatial distribution of the sound components captured on an array of P points defining a regular sampling of the sphere:

$$G_j(t)=Y^T h_j(t)$$

The maximum of this function $G_j(t)$ identifies a reflection. If $G_j(t)$ exhibits several maxima, these different maxima each identify one reflection. Thus, for each identified reflection, its characteristics are determined according to the following procedure: its instant of arrival corresponds to the sample $t_{Ri}=t$ for which it is identified, its incidence corresponds to the spatial coordinates $$C_{Ri}=(\theta_{Ri},\delta_{Ri})=(\theta_q,\delta_q)$$

of the point for which the maximum of $G_j(t)$ is observed, and its amplitude corresponds to the amplitude of this maximum $A_{Ri}=G_j(t_i)$. In the above, the index I marks the index of the reflection under consideration. The accuracy of estimation of these characteristics therefore depends on the number P of virtual loudspeakers used for this analysis. The first temporal sample for which a maximum is observed defines the instant of arrival of the direct wave. Care is taken to capture the amplitude ($A_D$) and the incidence of the latter ($C_D=(\theta_D, \delta_D)$, where $\theta_D$ and $\delta_D$ respectively define the angle of azimuth and the angle of elevation marking the direction of the direct wave).

Thus, from the multi-directional impulse responses obtained, considered over a temporal analysis window encompassing the instants of the early reflections of the audio signal reproduced by the loudspeakers, it is possible to determine, for each loudspeaker, the characteristics of the direct wave and the characteristics of the reflections that are associated with it. Thus, for the ji$^{th}$ loudspeaker, it is possible to determine, firstly, the characteristics of the direct wave such as its amplitude $A_D(j)$, its instant of arrival at the microphone $T_D(j)$ or its direction of incidence $C_D(j)$, and secondly, the characteristics of the reflections such as their amplitudes $A_{Ri}(j)$, their instants of arrival at the microphone $T_{Ri}(j)$ or their directions of incidence $C_{Ri}(j)$. Below, the amplitude normalized by the direct wave amplitude will preferably be used:

$$AN_{Ri}(j)=\frac{A_{Ri}(j)}{A_D(j)},$$

and the delay between the direct wave and the reflection:

$$\tau_{Ri}(j)=T_{Ri}(j)-T_D(j).$$

The early reflections of a played-back audio signal depend on the listening site at which the play-back assembly is placed. In general, these early reflections appear in a time situated in an interval going from 50 to 100 ms after the direct wave.

Advantageously, the analysis time window in step E202 will, in a suitable embodiment, be of a size between 50 and 100 ms.

Step E203 compares the amplitudes obtained by the analysis step with a perceptibility threshold Se for the reflections which has been defined beforehand and stored in the memory. Step E204 makes it possible to retrieve the predefined threshold value as a function of characteristics of each reflection and of the associated direct wave, which are obtained in the analysis step E202.

Indeed, several situations can arise. In a first exemplary embodiment, only the information about the direction of the reflections is known and recovered from the analysis step. To retrieve the corresponding perceptibility threshold, the value of the characteristic of instant of arrival of the reflection is set, for example the most critical value (that which gives maximum perceptibility) and the value of the perceptibility threshold is determined solely with respect to the value of the direction.

Similarly, if only the information about the instant of arrival of the reflection is known, the direction value can be set, for example the most critical value (that which gives maximum perceptibility) and it is possible to determine the perceptibility threshold according to the value of the instant of arrival.

Finally, in the case where both characteristics are known, the threshold value can be determined, with better accuracy, as a function of these two characteristics.

To do this, a table of perceptibility threshold values is stored in the memory. An example of such a table is illustrated with reference to FIG. 4. This table shows, for a direct sound situated at an angle of azimuth at 60°, the value of the perceptibility threshold of a reflection expressed in dB, as a function of the characteristics of angle of incidence of the reflection (i.e. its angle of azimuth $\theta_{Ri}$ in the horizontal plane corresponding to the elevation $\delta_{Ri}=0°$) and of arrival time of this reflection with respect to the arrival time of the direct wave $\tau_{Ri}(j)$. The threshold is defined as the relative level of the reflection, i.e. it represents the difference between the amplitude values (expressed in dB) of the reflection and of the direct wave under consideration.

This table of values is an example of threshold values defined on the basis of psychoacoustic experiments performed by considering various types of sound signal (speech, clicks, music, etc.), various angles of incidence and various arrival times of the reflections and of the direct wave. A perceptibility threshold for these reflections is defined as a function of these parameters.

Figure 4:
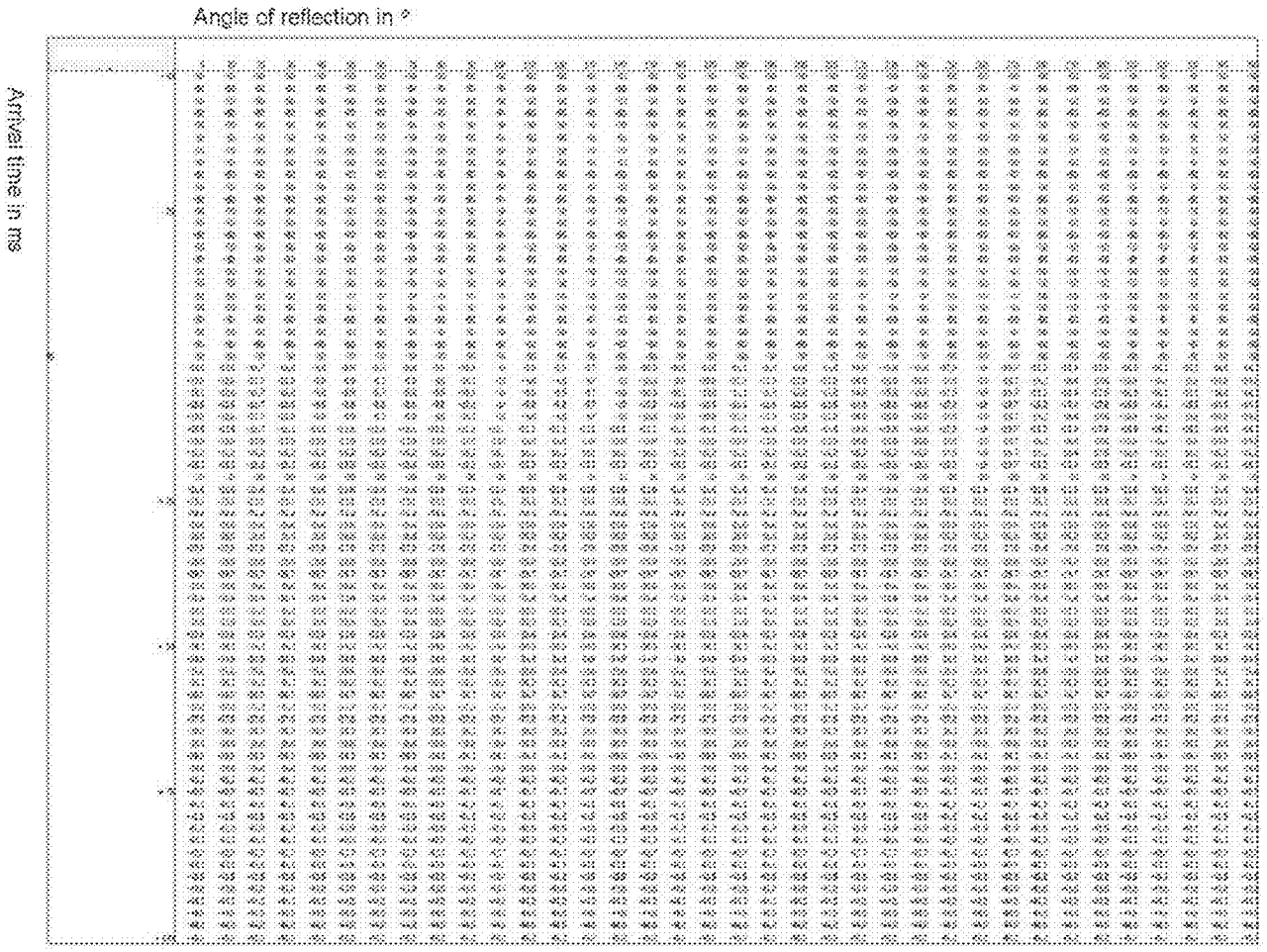
FIG. 4 represents an example of a table of values in dB that the perceptibility threshold used in the calibration method according to an embodiment of the invention can take, for a direct sound with a 60° angle of incidence, as a function of the angle of incidence (expressed in degrees) of the reflection and the arrival time (expressed in ms) of this reflection with respect to the instant of arrival t0 of the direct wave; the perceptibility threshold is defined as the level (in dB) of the reflection from which the level (in dB) of the direct wave is subtracted.
Figure 5:
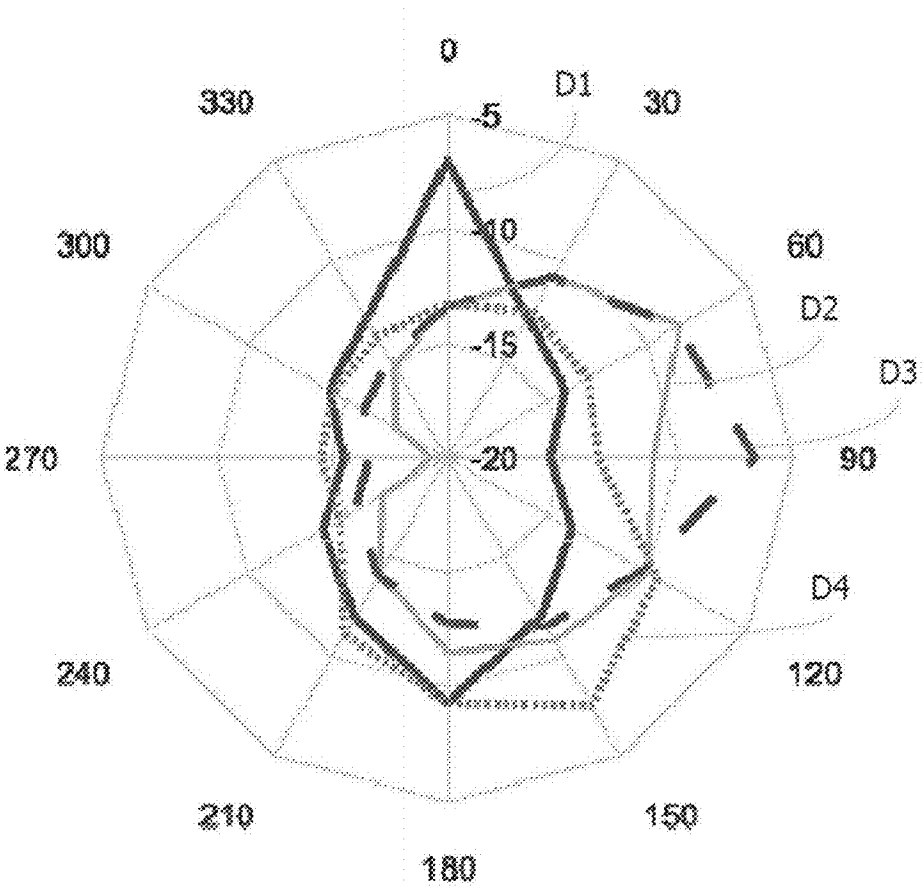
FIG. 5 presents another illustration of the values taken by the perceptibility threshold: this time the threshold is represented as a function of the incidence of the reflection, and this is repeated for various directions of the direct wave; in all cases, the delay of the reflection with respect to the direct wave is fixed and has a value of 15 ms.

To complete the illustration of the values of the perceptibility threshold in FIG. 4, FIG. 5 shows various curves for the perceptibility threshold expressed in dB (which still corresponds to the relative threshold corresponding to the difference between the level of the reflection and that of the direct wave). These various curves correspond to various positions of the direct wave (azimuth of 0° for D1, 60° for D2, 90° for D3 and 150° for D4) and represent the perceptibility thresholds as a function of the direction of the reflection, for a fixed arrival time (of 15 ms in this case).

Thus, in step E204, the threshold value corresponding to the characteristics obtained in the analysis step is retrieved. This threshold value is compared with the amplitude value of each reflection in step E203. To be compared with the perceptibility threshold, the value of the amplitude of the reflection is referenced to that of the associated direct wave and expressed in dB:

$$20\log(AN_{Ri}(j)).$$

In the case where the amplitude value of the reflection is below the perceptibility threshold value, this means that this reflection has no effect on the perception that a listener of the direct wave can have. This reflection is therefore not intended to be taken into account for the processing of a multi-channel signal before playback. Step E203 thus makes it possible to identify all the reflections that have no effect on the perception of the direct wave. Step E203 therefore identifies all the reflections for which the amplitude is below the perceptibility threshold.

Figure 6:
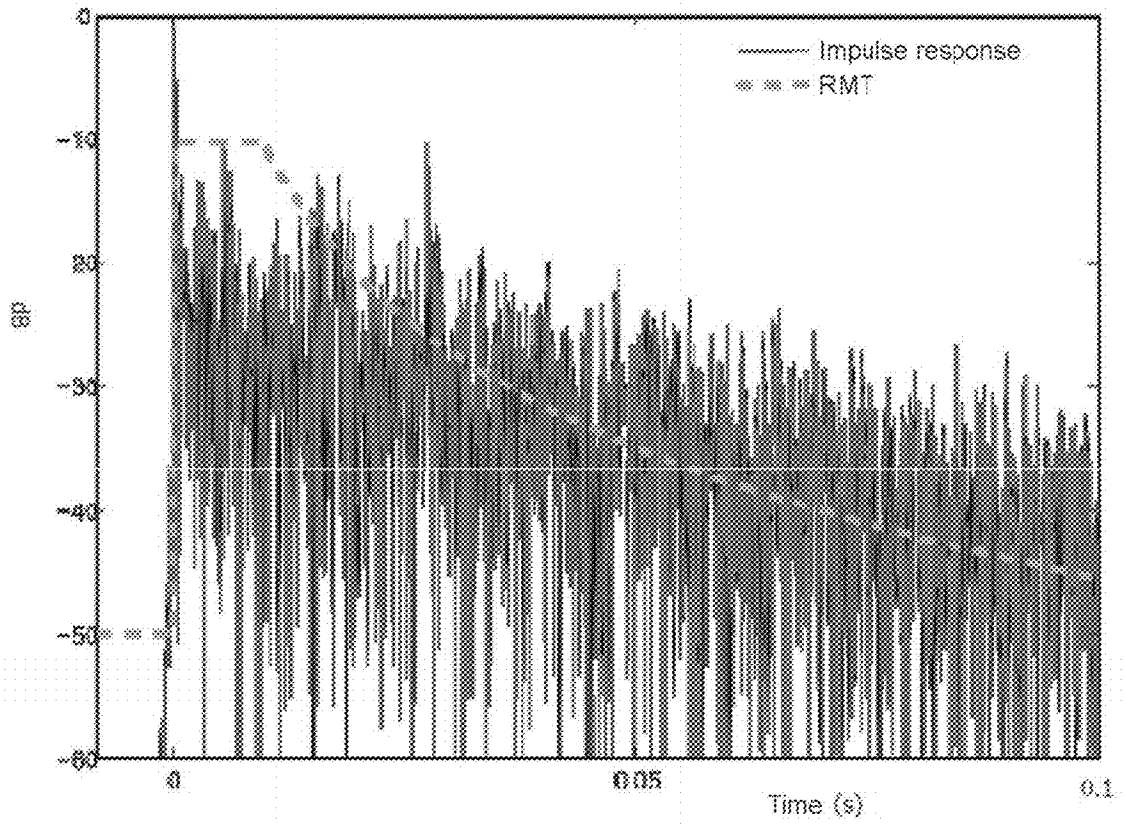
FIG. 6 represents an example of an impulse response from a loudspeaker in a playback system; the perceptibility threshold associated with each reflection is also reproduced by a dotted curve.

To illustrate this step E203, FIG. 6 represents an example of an impulse response, for a given direction, from one of the loudspeakers of the playback assembly in comparison with the broken line curve representing the perceptibility threshold (RMT for "Reflection Masked Threshold") obtained using the table described above with reference to FIG. 4. The reflections whose level is below the threshold curve are thus identified. It should be noted that in the illustrated case, the early reflections arising in the 15 first ms are not perceptible.

On the basis of this identification of non-perceptible reflections, step E205 modifies the impulse responses $h_j(t)$ obtained in step E201 for the j=1 to N loudspeakers, in order to obtain perceptual impulse responses $hp_j(t)$. For this, the modification consists in eliminating the non-perceptible reflections identified in step E203 in the impulse responses.

In more detail, this operation is carried out using a thresholding operation, for example. At each instant t, the value of the perceptibility threshold Se is deducted from the impulse response signal that was obtained in step E201.

Preferably, this processing is applied to the spatial spectrum defined by the K components $h_j(t)=[H_{j1}(t) \ldots H_{jI}(t) \ldots H_{jK}(t)]$ in the chosen domain of spatial representation, corresponding to the representation based on spherical harmonics, for example. However, the processing can also be applied in the dual domain of space coordinates. The operation performed in the case of the spatial spectrum is described below.

The thresholding operation consists in comparing the amplitude of each identified reflection with the perceptibility threshold Se associated with its characteristics. Thus, for the $i^{th}$ reflection identified for the $ji^{th}$ loudspeaker, the threshold Se(i) is determined as a function of its characteristics $[\tau_{Ri}(j), C_{Ri}(j)]$. This reflection is located at the instant $t_i$ given by:

$$t_i=T_D(j)+\tau_{Ri}(j).$$

To perform the thresholding, the impulse response at this instant is therefore considered, i.e. $h_j(t_i)$, or more precisely on the associated spatial spectrum composed of the K components $[H_{j1}(t_i) \ldots H_{jI}(t_i) \ldots H_{jK}(t_i)]$. Several strategies are then possible. The simplest consists in preserving the relative amplitude of the components of the spatial spectrum, i.e. an identical process is applied to all the components. In this case, for each component $H_{jI}(t)$, the thresholding operation can be translated by the following equations:

$$HP_{ji}(t_i) = 0 \qquad \text{if } AN_{Ri}(j) \le 10^{0.05\,Se}$$

$$HP_{ji}(t_i) = (|H_{ji}(t_i) - 10^{0.05\,Se}|)\frac{H_{ji}(t_i)}{|H_{ji}(t_i)|} \qquad \text{if } AN_{Ri}(j) > 10^{0.05\,Se}$$

where $HP_{jI}(t)$ denotes the perceptual impulse response associated with $H_{jI}(t)$.

Thus, the perceptual impulse responses preserve only the reflections with a significant effect on the perception of the direct wave.

These perceptual impulse responses are then used to determine the filtering matrix, in step E206. This filtering matrix is then used to process the multi-channel audio signal before its sound playback by the playback assembly of the system.

To obtain the set of filters forming the filtering matrix Filt of the processing device, a possible embodiment has a step of determining an error signal defined by the difference between a predetermined target response signal for the playback assembly and a response signal reconstructed from perceptual impulse responses and a step of multi-channel inversion by minimization of the error signal thus determined.

The error signal thus obtained therefore takes into account only the perceptible reflections since it is computed from a reconstructed signal based on the perceptual impulse responses.

The inversion can be performed by way of a gradient descent algorithm or its variants. One example of a possible inversion algorithm is that of ISTA (for "Iterative Shrinkage-Thresholding algorithm") type as described in the document titled "A Fast Iterative Shrinkage-Thresholding Algorithm for Linear Inverse Problems" by Amir Beck & Marc Teboulle, published in SIAM J. IMAGING SCIENCES, Vol. 2, No. 1, pp. 183-202 in 2009.

In general, the problem that arises in computing the filters of the processing matrix is as follows. There are N loudspeakers which form the real reproduction system. In the higher-order ambisonic (HOA) spatialization context, the space of spatial representation has a dimension K. The spatial information is therefore described by K coefficients. The goal is to use the system of N loudspeakers to reproduce a set of V signals defining the input multi-channel audio signal. These V signals are dedicated to an ideal reproduction system composed of V loudspeakers. This ideal system defines the V target signals that are intended to be reproduced and which therefore correspond to the responses of a fictional system of V virtual loudspeakers. In the simplest case, the real reproduction system also has N=V loudspeakers. In the general case, however, it is possible to emulate a system of V virtual loudspeakers from a device of N real loudspeakers.

The equation to be solved is as follows:

$$T(t)=H*W(t)$$

with H, the matrix of dimensions K×N having the impulse responses of the N elements of the playback system in the spatial analysis domain, W, the matrix having the corrective filters to be computed, of dimensions N×V, T, the matrix containing the V target responses defined in the spatial analysis domain of dimensions K×V, and the operation denoted by "*" is a convolutive matrix product where an element $T_{ij}$ of the matrix T is obtained as follows:

$$T_{ij}(t) = \sum_{k=1}^{N} H_{ik} * W_{kj}(t)$$

Each matrix is a matrix of vectors, in the sense that the third dimension corresponds to the time scale.

The goal of the inversion operation is to find the elements of the matrix W.

This operation can be resolved in two phases. First, the corrective filters are computed by correcting only the room effect of the playback site, i.e. the real device of loudspeakers, or N loudspeakers, is taken into account. In a second step, the arrangement of the loudspeakers is compensated for in order to adapt the V signals to playback according to a non-ideal configuration of N loudspeakers. To this effect, the V signals are distributed by matrixing over the N channels associated with the real reproduction system in order to emulate a system of V virtual loudspeakers.

In the present case, to implement the invention, the elements of the matrix H have the perceptual impulse responses as obtained in step E205.

The target responses can vary according to the sound playback result expected.

In an embodiment, this target response corresponds to the impulse response given by the direct wave alone without any reflection. This equates to suppressing the entire room effect in the expected signal.

In a first variant embodiment, the target response signal corresponds to the response of a direct wave associated with reflections representing a predetermined listening site.

A characteristic listening site which has a good sound quality may be desired (for example the listening site of the Pleyel™ room). In this case, the processing filters will be computed to obtain sound playback close to this sound quality.

In a second variant embodiment, the target response signal corresponds to the response of a direct wave associated with reflections representing a playback assembly different from that used to play back the resulting signal.

Thus, a desired playback system, for example having more loudspeakers, is taken as a reference in order to obtain playback close to that which would have been obtained with such a system.

Other target response signals can of course be chosen according to the desired playback effect.

Thus, the implementation of the method described makes it possible to obtain a better sound quality during the playback of a multi-channel audio signal by virtue of only the perceptible reflections of the signals being taken into account by the playback assembly at the listening site.

Figure 7:
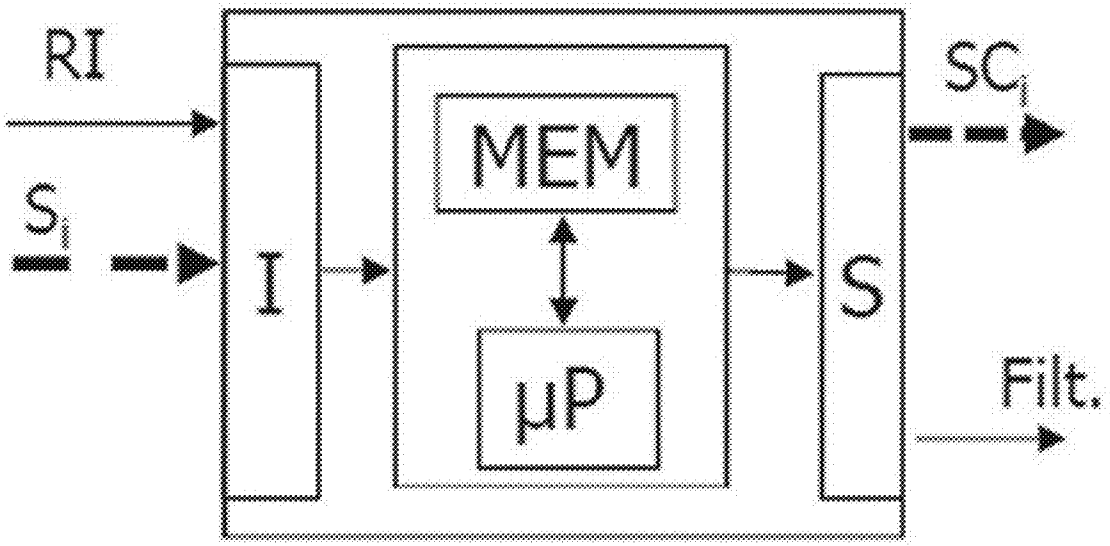
FIG. 7 represents an example of a hardware embodiment of a calibration device according to an embodiment of the invention.

FIG. 7 represents an example of a hardware embodiment of a calibration device according to the invention. This can be an integral part of an audio/video decoder, of a processing server, of a conference bridge or of any other audio or video reading or broadcasting equipment.

This type of device includes a μP processor cooperating with a memory block MEM having a storage and/or working memory.

The memory block can advantageously have a computer program having code instructions for the implementation of the steps of the calibration method in the sense of the invention when these instructions are executed by the processor, and in particular the steps of obtaining multi-directional impulse responses from the loudspeakers of the playback assembly upon reproduction of a predetermined audio signal, of analyzing the multi-directional impulse responses obtained, in a domain of spatio-temporal representation, over at least one time window encompassing the instants of arrival of the early reflections of the reproduced predetermined audio signal in order to determine a set of characteristics of the early reflections, of comparing the amplitude of each of the reflections with a predetermined perceptibility threshold and identifying the non-perceptible reflections for which the amplitude is below the predetermined threshold, of modifying the impulse responses obtained in order to obtain perceptual impulse responses, by suppression of the reflections identified as non-perceptible, and of determining a filtering matrix from the perceptual impulse responses for an application of this filtering matrix to the multi-channel audio signal before sound playback.

Typically, the description of FIG. 2 repeats the steps of an algorithm of such a computer program. The computer program can also be stored on a memory medium readable by a reader of the device or downloadable in the memory space of the latter.

The memory MEM records a table of perceptibility threshold values, as a function of characteristics of the sound components composed of the direct wave and the reflections, that is used in the method according to an embodiment of the invention and, in general, all the data required for the implementation of the method.

Such a device has an input module I able to receive impulse responses from a playback assembly and an output module S able to transmit the computed filters of a filtering matrix to a processing module.

In a possible embodiment, the device thus described can also have the functions of processing by the implementation of the processing matrix upon reception of a multi-channel signal Si at I in order to transmit processed signals SCi to the output that are able to be played back by the playback assembly.

Although the present disclosure has been described with reference to one or more examples, workers skilled in the art will recognize that changes may be made in form and detail without departing from the scope of the disclosure and/or the appended claims.

The invention claimed is:

1. A method for calibrating an assembly for sound playback of a multi-channel sound signal having a plurality of loudspeakers, wherein the method comprises:

obtaining multi-directional impulse responses from the loudspeakers of the playback assembly upon reproduction of a predetermined audio signal;

analyzing the multi-directional impulse responses obtained, in a domain of spatio-temporal representation, over at least one time window encompassing instants of arrival of early reflections of the reproduced predetermined audio signal in order to determine a set of characteristics of the early reflections comprising at least the amplitude;

comparing the amplitude of each of the reflections with a determined perceptibility threshold and identifying non-perceptible reflections for which the amplitude is below the determined threshold;

modifying the impulse responses obtained in order to obtain perceptual impulse responses, by suppression of the reflections identified as non-perceptible;

determining a filtering matrix by determining an error signal defined by the difference between a predetermined target response signal for the playback system and a response signal reconstructed from the perceptual impulse responses and by a multi-channel inversion by minimization of the error signal thus determined in order to obtain filters of the filtering matrix; and application of this filtering matrix to the multi-channel audio signal before sound playback.

2. The method as claimed in claim 1, wherein the perceptibility threshold is determined as a function of characteristics of a direct wave and of the early reflections of the predetermined audio signal.

3. The method as claimed in claim 2, wherein the perceptibility threshold is determined as a function of the direction of incidence of the direct wave and/or its amplitude, and the directions of incidence of the early reflections and/or their arrival times with respect to the direct wave.

4. The method as claimed in claim 1, wherein the predetermined target response signal corresponds to the response of a direct wave of the predetermined audio signal alone without any reflection.

5. The method as claimed in claim 1, wherein the predetermined target response signal corresponds to the response of a direct wave of the predetermined audio signal associated with reflections representing a predetermined listening site.

6. The method as claimed in claim 1, wherein the predetermined target response signal corresponds to the response of a direct wave of the predetermined audio signal associated with reflections representing a different playback assembly.

7. A device for calibrating an assembly for sound playback of a multi-channel sound signal having a plurality of loudspeakers, wherein the device comprises:

a module configured to obtain multi-directional impulse responses from the loudspeakers of the playback assembly upon reproduction of a predetermined audio signal;

a module configured to analyze the multi-directional impulse responses obtained, in a domain of spatio-temporal representation, over at least one time window encompassing instants of arrival of early reflections of the reproduced predetermined audio signal in order to determine a set of characteristics of the early reflections comprising at least the amplitude;

a module configured to compare the amplitude of each of the reflections with a determined perceptibility threshold and for identifying non-perceptible reflections for which the amplitude is below the determined threshold;

a module configured to modify the impulse responses obtained in order to obtain perceptual impulse responses, by suppression of the reflections identified as non-perceptible by the identification module;

a module configured to compute a filtering matrix by determining an error signal defined by the difference between a predetermined target response signal for the playback system and a response signal reconstructed from the perceptual impulse responses and by a multi-channel inversion by minimization of the error signal thus determined in order to obtain filters of the filtering matrix; and a module configured to apply this filtering matrix to the multi-channel audio signal before sound playback.

8. An audio decoder having a calibration device as claimed in claim 7.

9. A non-transitory storage medium, readable by a processor, on which a computer program is stored comprising code instructions for execution of a method for calibrating an assembly for sound playback of a multi-channel sound signal having a plurality of loudspeakers, when the instructions are executed by a processor, wherein the method comprises:

obtaining multi-directional impulse responses from the loudspeakers of the playback assembly upon reproduction of a predetermined audio signal;

analyzing the multi-directional impulse responses obtained, in a domain of spatio-temporal representation, over at least one time window encompassing instants of arrival of early reflections of the reproduced predetermined audio signal in order to determine a set of characteristics of the early reflections comprising at least the amplitude;

comparing the amplitude of each of the reflections with a determined perceptibility threshold and identifying non-perceptible reflections for which the amplitude is below the determined threshold;

modifying the impulse responses obtained in order to obtain perceptual impulse responses, by suppression of the reflections identified as non-perceptible;

determining a filtering matrix by determining an error signal defined by the difference between a predetermined target response signal for the playback system and a response signal reconstructed from the perceptual impulse responses and by a multi-channel inversion by minimization of the error signal thus determined in order to obtain filters of the filtering matrix; and application of this filtering matrix to the multi-channel audio signal before sound playback.

10. The non-transitory storage medium as claimed in claim 9, wherein the method further comprises:

receiving the multi-channel sound signal by the assembly;

applying the multi-channel sound signal to the determined filtering matrix to produce output signals;

transmitting the output signals to a playback device to which the loudspeakers are connected.

11. The method as claimed in claim 1, further comprising:

receiving the multi-channel sound signal by the assembly;

applying the multi-channel sound signal to the determined filtering matrix to produce output signals;

transmitting the output signals to a playback device to which the loudspeakers are connected.

* * * * *